United States Patent [19]

Andersson

[11] 4,413,853

[45] Nov. 8, 1983

[54] LIFTING MEANS FOR GOODS

[76] Inventor: Sten Andersson, Torpadala, P.O. Box 1683, S-430-33 Fjäras, Sweden

[21] Appl. No.: 306,611

[22] PCT Filed: Feb. 3, 1981

[86] PCT No.: PCT/SE81/00030

§ 371 Date: Sep. 16, 1981

§ 102(e) Date: Sep. 16, 1981

[87] PCT Pub. No.: WO81/02289

PCT Pub. Date: Aug. 20, 1981

[30] Foreign Application Priority Data

Feb. 4, 1980 [SE] Sweden ..... 8000861
Sep. 22, 1980 [SE] Sweden ..... 8006607

[51] Int. Cl.[3] ..... B66C 1/02
[52] U.S. Cl. ..... 294/64 R; 414/627
[58] Field of Search ..... 294/64 R, 65; 137/630.14; 269/21; 414/627, 737, 744 B, 752

[56] References Cited

U.S. PATENT DOCUMENTS

| | | | |
|---|---|---|---|
| 2,557,260 | 6/1951 | Clark | 294/64 R |
| 3,318,468 | 5/1967 | Olson | 294/64 R X |
| 3,743,340 | 7/1973 | Williamann | 294/64 R |
| 4,067,359 | 1/1978 | Kwast | 137/630.14 |

*Primary Examiner*—Johnny D. Cherry
*Attorney, Agent, or Firm*—Burgess, Ryan & Wayne

[57] ABSTRACT

A lifting device comprising a tube (A) sealed at both ends or a pipe similarly closed at both ends. Both tube (A) and pipe are compressible in the axial direction. By regulating the vacuum in the space defined by the tube (A) or pipe, the length of the tube or pipe can be regulated, thus raising or lowering goods connected to the tube (A) or pipe. An arrangement is provided to permit rotation of the tube in relation to its support, and to act as a vacuum check valve.

11 Claims, 4 Drawing Figures

LIFTING MEANS FOR GOODS

Figure 1:
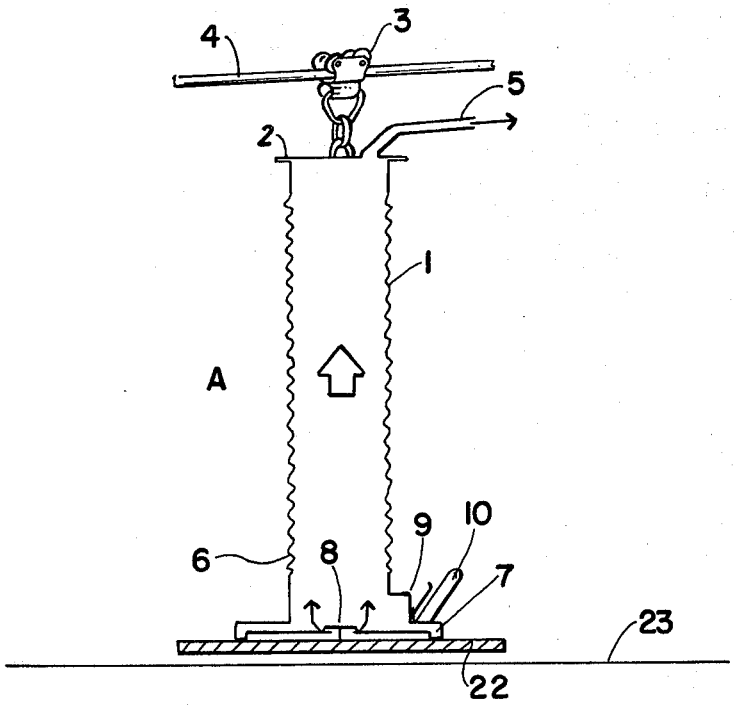

The present invention relates to a lifting means for goods. The invention is particularly directed to the movement of goods in vertical and horizontal directions where the difference in vertical direction is moderate. Hitherto lifting tables and motors with winches and lifting hooks have been utilized. A lifting means of the type just mentioned can be arranged in the form of a telpher movable along a rail arranged in the ceiling of factory premises. Lifting tables are practical but are unable to grip hold of goods. Motors and winches also function satisfactorily but a moving cable on ground level may cause damage to persons, which is a drawback. Obviously damage to persons can be avoided by due care. However, the human factor unfortunately cannot be disregarded.

The present invention relates to a lifting means which is simple and designed so as not to cause damage to persons in the vicinity when operating on ground level. This is achieved according to the invention by using an elongate tubular container which is closed at both ends, one end being attached to an anchoring point which may be fixed or movable and the other end of the container being brought into communication with goods to be moved. The connection may be direct or indirect. The tubular wall of the container can be extended or shortened in the axial direction, thus providing movement in the vertical direction. Extension or shortening is achieved by connecting the inside of the container to a vacuum-generating means which regulates the vacuum in the space defined by the tube.

The vacuum inside the container is regulated by means of control members preferably consisting of a valve arrangement controlling the pressure ratio between the inside of the container and its surroundings.

The valve arrangement may be designed to be opened in two steps, a smaller opening being exposed in the first step, so that the opening ratio is adjustable. In the second step the valve arrangement is fully opened.

According to a preferred embodiment of the present invention, the other end of the container is designed as a suction body so that the container can be applied to the goods to be moved via the suction body.

The other end of the container may also be designed in such a way that it is joined to a separate suction body which is in communication with the vacuum-generating means either directly or via the inside of the container.

The other end of the container may be shaped as or provided with a lifting hook.

The cylindrical wall of the container consists preferably of rubber, plastic or some other material which is compressible in axial direction, forming horizontal folds.

The wall of the tubular container may be reinforced in some way, such as by a spiral the axis of which coincides with the axis of the tubular container. The spiral may be of spring-steel so that it always strives to keep the tubular wall of the container maximally extended.

The tubular wall of the container may have sections along its longitudinal extension which are not compressible.

Further characteristics of the present invention are revealed in the following description.

Figure 2:
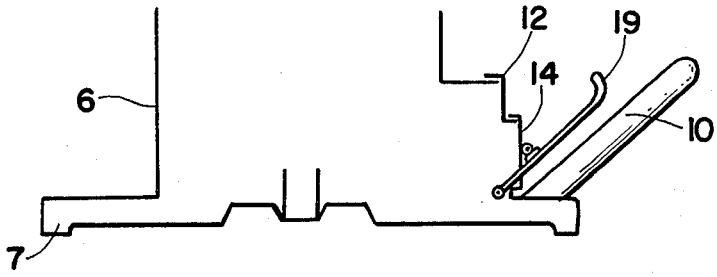
Figure 3:
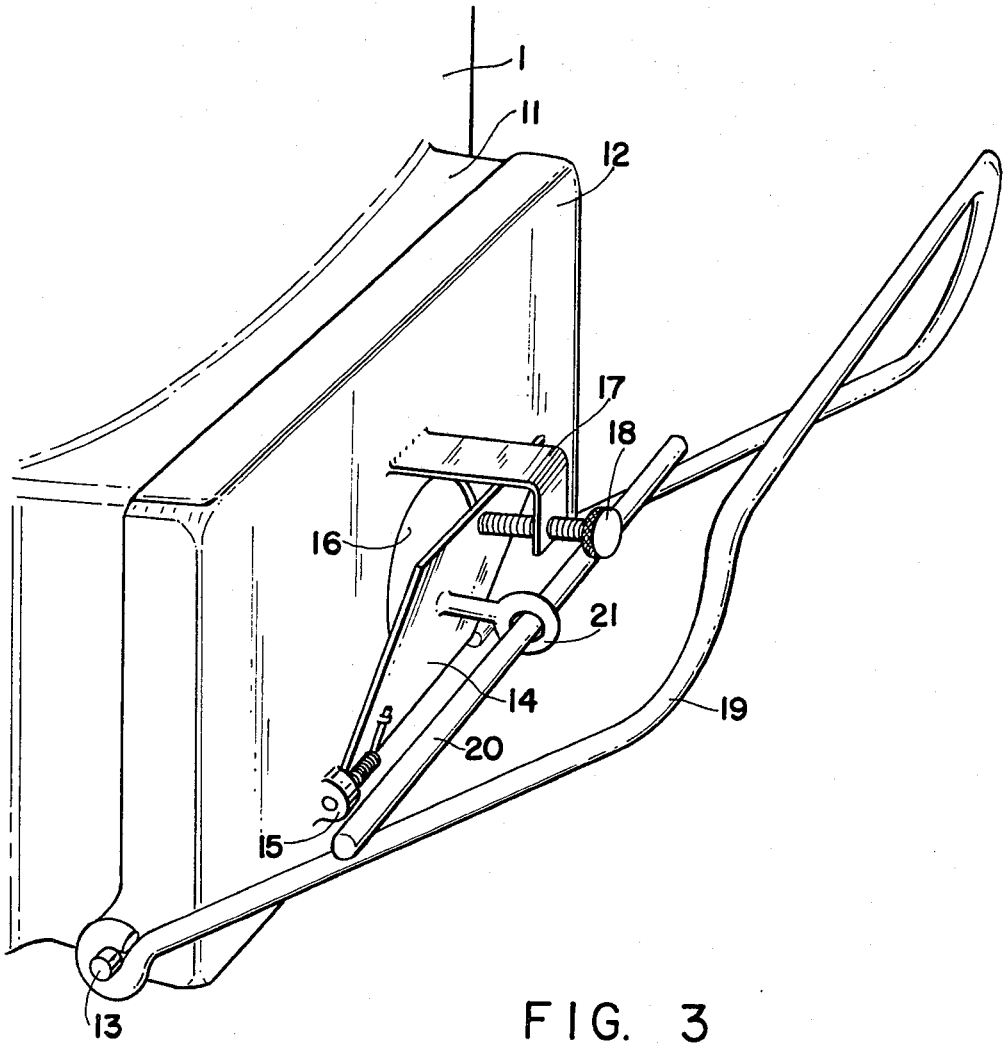
Figure 4:
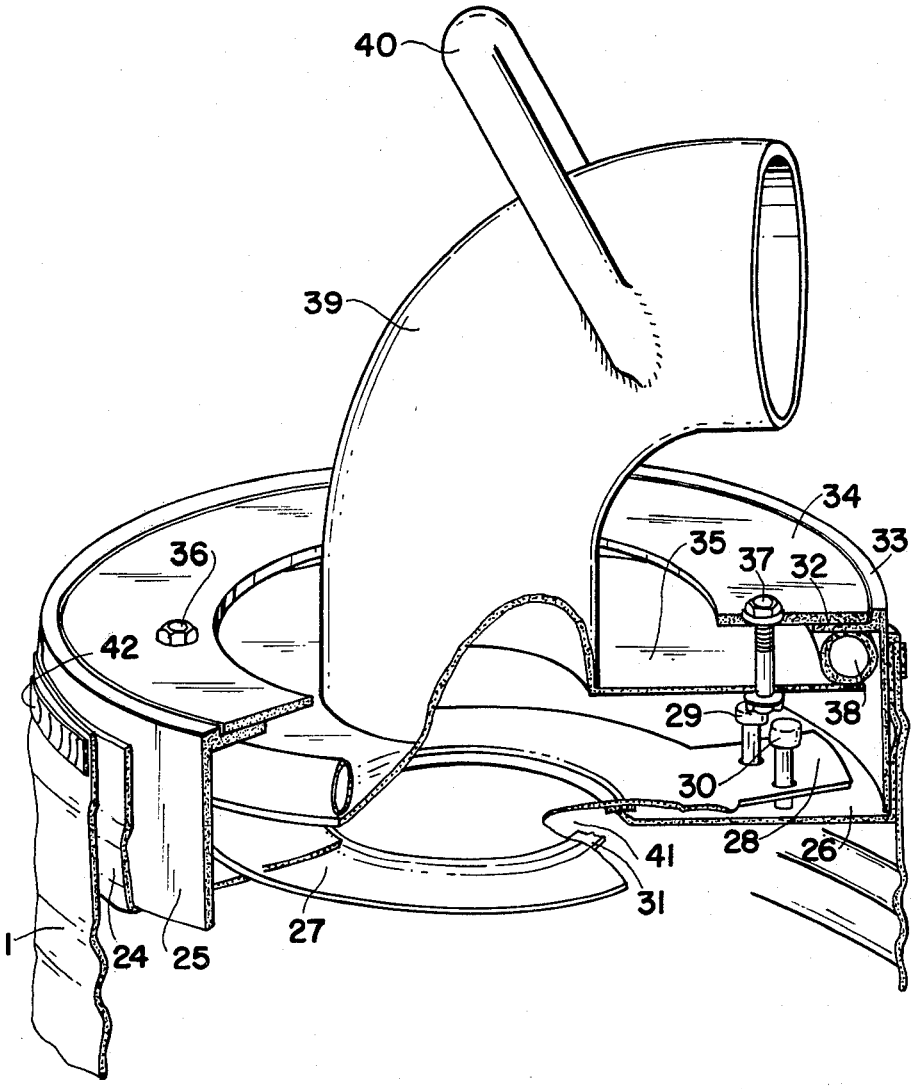

The invention will be described more fully with reference to the accompanying drawings in which FIG. 1 shows a lifting means according to the present invention, FIG. 2 shows an enlargement of the lower part of the lifting means, FIG. 3 shows an enlargement of the valve arrangement of the lifting means and FIG. 4 shows an embodiment of the upper part of the lifting means.

In the drawings A is a lifting means comprising a tube-like unit 1 having a wall enabling the tube to be compressed in axial direction. The tube suitably consists of rubber, plastic or other similar material and is corrugated in order to facilitate compression. The tube is provided with reinforcement consisting of a spiral spring of spring-steel. The axis of the spiral coincides with the axis of the tubular unit. The tubular unit is sealed at the top end by a disc-shaped body 2 which, is joined by means of links or in some other way, to a telpher movable along a rail 4. The disc-shaped body 2 is provided with an outlet 5 joining the inside of the tubular unit 1 to a vacuum-generating means. The tubular unit is sealed at its lower end by a suction body 6 having a plate or disc provided on its lower side with a peripheral seal 7 of elastomeric material. At the centre of the disc or plate is a spring-actuated sealing disc 8 which, upon spring action, closes the openings between the space inside the tubular unit and the space which can be formed by the disc with the peripheral seal 7 and an object 22 to be moved which may be placed on ground level 23.

When the spring-actuating sealing disc is influenced by the object 22 the sealing disc assumes open position. In the absence of object 22 the sealing disc 8 assumes closed position. At the part in communication with the inside of the tubular unit 1 the suction body 6 is provided with a valve arrangement 9. The valve arrangement consists of an opening 11 formed by a tubular part. The opening cooperates with a first cover 12 which is hinged at its lower part by means of pins, the lefthand pin 13 being shown in FIG. 3. An opening 16 is arranged in the first cover 12, said opening cooperating with a second cover 14 having a spring-actuated journal 15 at its lower end which is designed to keep the cover closed. The first cover is provided with a flange 17 provided with a setting screw 18 to regulate the extent to which the second cover 14 shall open. An operating shackle 19 is journalled in the pins 13 of the first cover 12. A transverse rod 20 is attached to the shackle. The rod passes through an eye 21 permanently secured to the second cover 14.

A lifting handle 10 is also arranged on the suction body 6.

The suspension arrangement between the disc-shaped body 2 and the telpher 3 may be such that it can alter length vertically.

The lifting means according to the present invention functions in the following manner: It is assumed that the tubelike unit is not subjected to vacuum and thus has its maximum length. It is also assumed that the suction body 6 is not in communication with any object 22 to be moved. This means that the spring-actuated sealing disc 8 is in closed position. In this state the lifting means is moved to an object 22 which is to be moved. When this has been done, the spring-actuating disc 8 will be in open position. If the vacuum-generator is started the suction body 6 will adhere to the object 22 and the vacuum in the space enclosed by the tubelike unit 1 will alter so that the tubelike unit is gradually compressed and lifts the object 22 to the desired height. The raised object can then be moved by the telpher 3 to the desired place. The raised object can then be gently or quickly lowered again depending on how the valve arrangement 9 is operated. By carefully operating the shackle 19, the second cover 14 can be gradually opened until the setting screw 18 limits the opening movement. The object 22 is thus slowly lowered. When a lowering process has been completed the shackle 19 can again be operated so that the first cover 12 is fully opened. The valve arrangement 9 is thus fully opened, the suction body 6 thus loses its adhesion and the lifting means can be removed from the object 22 which is deposited on the ground 23.

It should be clear that the control of the lifting means obtained through the valve arrangement 9 can be replaced by a control of the vacuum-generating means connected to the outlet 5.

The suction body 6 described above is designed as a lower sealing section of the tubelike unit 1 and the suction body acquires its adhesive action by way of the space inside the tubelike unit. It is no doubt clear that the suction body 6 can be replaced by a suction body applied to the lower end of the tubelike unit, which is closed in some other way, as a separate unit, separately connected to a vacuum-generating member.

The lifting means according to the present invention may be provided with a lifting hook instead of a suction body, in which case the object is lifted by means of cables.

FIG. 4 again shows the tubelike unit 1. The tubelike unit 1 is applied on an outer, tubular part 24 and held in place by a clamp 42. The outer, tubular part 24 is provided with a bottom 26 with a hole 41. Above the hole is a loose circular disc 27 provided with a tongue 28. The tongue 28 is provided with two holes through which two screws 29 and 30 pass. The screws are attached in the bottom 26. The screws are not fully screwed in so that the disc 27 can move between the bottom 26 and the screw heads 29, 30. The disc is provided on its lower side with a sealing ring 31 so that when it is in contact with the bottom 26 it seals the hole 41. A second tubular part 25 is located inside the outer, tubular part 24. The two tubular parts 24 and 25 are in close contact with each other. The tubular part 25 is provided at the top with a peripheral flange 32 which is directed inwards. At its outer end the peripheral flange 32 is provided with a limiting strip 33 running round the periphery. A disc-shaped ring 34 rests on the peripheral flange 32 and may be made of any suitable material. A preferred material is plastic. The disc-shaped ring is joined to a circular disc 35 by means of joints 36 and 37 in the form of screws and bolts. The two joints 36 and 37 may also be designed to include pressure members endeavouring to force the disc 35 and the ring 34 towards each other. The circular disc 35 is preferably of metal and has a central hole for the connection 39 to the vacuum-generator. The connection 39 is of metal and is provided with a suspension eye 40 so it can be hung in the telpher 3. The disc 35 is provided at its periphery with a sealing ring 38 lying partly in contact with the disc 35, partly against the lower surface of the peripheral flange 32. The joints 36 and 37 are tightened sufficiently for the space under the disc 35 to be completely sealed upwards except for the connection 39.

By suspending the disc 35 and ring 34 by means of the eye 40, these can be made to remain immovable about a vertical axis while the tubular part 25 can be turned about said ring 34 and disc 35, and thus also the tubular unit 1. The load being carried can thus be turned to various positions. When the vacuum-generator is in function the disc 7 is lifted up so that the opening 41 is exposed. In the event, contrary to expectation, of the vacuum-generator ceasing to function, the disc 27 will immediately fall down over the hole and cover it so that the vacuum in the tubular container is maintained as far as possible and only changes very slowly so that a load carried by the lifting means is not immediately dropped.

I claim:

1. Lifting apparatus connectable to a fixed or movable anchoring point and having an object engaging portion capable of vertical movement in relation to the anchoring point, comprising:

a tubular container having a vertically oriented axis and closed upper and lower ends, said upper end being connectable to said anchoring point, said lower end comprising an annular seal for engaging a surface of an object to be lifted, for forming a substantially airtight seal against said surface, and for gripping said object when the interior of said container is evacuated and the vacuum within the container is communicated to a space encompassed by said seal;

at least a portion of the wall of said container being compressible or foldable in the axial direction to reduce the length of the container in the axial direction when the interior of the container is at least partially evacuated;

a vacuum port communicating with the interior of said container, said port being adapted for connection to a source of vacuum;

a vacuum break door in the wall of said container, said door when opened communicating with the interior of said container to the atmosphere to break the vacuum within the container and thereby release said object, said door having a hatch therein which, when opened, reduces the vacuum within said container to thereby allow the length of the container to increase; and an actuating means for successively opening said hatch and door, said actuating means having (i) a first position wherein only the hatch is opened to gradually lower said seal and (ii) a second position wherein said door is opened to release said object.

2. The apparatus according to claim 1, further comprising means for adjusting the extent of opening of said hatch.

3. The apparatus according to claim 1, wherein said vacuum port is adjacent the upper end of said container and said vacuum break door is adjacent the lower end thereof.

4. The apparatus according to claim 1, wherein said vacuum port is adjacent the upper end of said container and comprises a rotary joint.

5. The apparatus according to claim 1, wherein said annular seal is separated from the adjacent portion of the lower end of said container by a bottom wall, further comprising a valve in said bottom wall for communicating with the space encompassed by said seal with the interior of said container when said valve is actuated, and an actuating member for actuating said valve when said seal is contiguous with said object surface.

6. The apparatus according to claim 1, wherein said port comprises a check valve.

7. Lifting apparatus connectable to a fixed or movable anchoring point and having an object engaging portion capable of vertical movement in relation to the anchoring point, comprising:

a tubular container having a vertically oriented axis and closed upper and lower ends, said upper end being connectable to said anchoring point, said lower end comprising an annular seal for engaging a surface of an object to be lifted, for forming a substantially airtight seal against said surface, and for gripping said object when the interior of said container is evacuated and the vacuum within the container is communicated to a space encompassed by said seal;

at least a portion of the wall of said container being compressible or foldable in the axial direction to reduce the length of the container in the axial direction when the interior of the container is at least partially evacuated;

a vacuum port adjacent the upper end of said container and communicating with the interior of said container, said port being adapted for connection to a source of vacuum and comprising a rotary joint coaxial with said container, said rotary joint comprising:

an annular part having a cylindrical wall and an inwardly directed peripheral flange, said annular part being rotatable about the axis of said container with respect to the container, a circular disk adjacent said flange, said disk having a central hole therein, an annular seal between and contiguous with said circular disk and said flange, a disk-shaped ring coaxial with and abutting said annular flange, means securing together said circular disk, annular seal, and annular part for rotation as a unit, a conduit having one end coaxial with said container and secured to said circular disk at the periphery of said central hole, so that said conduit communicates with the interior of said container, and means secured to said conduit for connection to an anchoring point.

8. The apparatus according to claim 7, further comprising spring means for urging said circular disk and disk-shaped ring toward each other.

9. The apparatus according to claim 7, further comprising vacuum check valve means between said circular disk and the interior of said container.

10. The apparatus according to claim 7, further comprising:

an outer annular part having a cylindrical wall substantially surrounding the cylindrical wall of said first-mentioned annular part, said outer annular part being secured to said container and having an inwardly extending disk portion with a central hole therein, and a vacuum check disk disposed for axial movement between said inwardly extending disk portion of said outer annular part and said circular disk, for being drawn against said circular disk to seal said hole therein to prevent loss of vacuum when said port is not connected to a vacuum source.

11. Lifting apparatus connectable to a fixed or movable anchoring point and having an object engaging portion capable of vertical movement in relation to the anchoring point, comprising:

a tubular container having a vertically oriented axis and closed upper and lower ends, said upper end being connectable to said anchoring point, said lower end comprising an object engaging portion for engaging a surface of an object to be lifted;

at least a portion of the wall of said container being compressible or foldable in the axial direction to reduce the length of the container in the axial direction when the interior of the container is at least partially evacuated;

a vacuum port communicating with the interior of said container, said port being adapted for connection to a source of vacuum;

a vacuum break door, said door when opened communicating with the interior of said container to the atmosphere to break the vacuum within the container, said door having a hatch therein which, when opened, reduces the vacuum within said container to thereby allow the length of the container to increase; and an actuating means for successively opening said hatch and door, said actuating means having (i) a first position wherein only the hatch is opened to gradually reduce the vacuum within said container and (ii) a second position wherein said door is opened to substantially eliminate the vacuum within said container.

* * * * *